US008465826B2

(12) United States Patent
Balcar

(10) Patent No.: US 8,465,826 B2
(45) Date of Patent: Jun. 18, 2013

(54) MULTI-FUNCTIONING INSERT

(75) Inventor: Vaclav Balcar, Ceska Cermna (CZ)

(73) Assignee: Servisbal Obaly S.R.O., Dobruska (CZ)

( * ) Notice: Subject to any disclaimer, the term of this patent is extended or adjusted under 35 U.S.C. 154(b) by 0 days.

(21) Appl. No.: 13/141,887

(22) PCT Filed: Apr. 22, 2009

(86) PCT No.: PCT/CZ2009/000057
§ 371 (c)(1),
(2), (4) Date: Jun. 23, 2011

(87) PCT Pub. No.: WO2010/072182
PCT Pub. Date: Jul. 1, 2010

(65) Prior Publication Data

US 2011/0256352 A1 Oct. 20, 2011

(30) Foreign Application Priority Data

Dec. 24, 2008 (CZ) ..... PV 2008-844

(51) Int. Cl.
*B32B 3/00* (2006.01)
*B32B 3/04* (2006.01)

(52) U.S. Cl.
USPC ..... 428/156; 428/121; 428/126; 428/192

(58) Field of Classification Search
USPC .. 428/156, 121, 126, 130, 124, 192; 206/521, 206/584; 493/967, 968, 464
See application file for complete search history.

(56) References Cited

U.S. PATENT DOCUMENTS

| | | | | |
|---|---|---|---|---|
| 3,436,297 | A * | 4/1969 | Charles et al. | 428/164 |
| 5,712,020 | A * | 1/1998 | Parker | 428/182 |
| 6,207,249 | B1 * | 3/2001 | Lencoski et al. | 428/132 |
| 2004/0058129 | A1 * | 3/2004 | Bouic et al. | 428/156 |

FOREIGN PATENT DOCUMENTS

WO 96/40493 12/1996

OTHER PUBLICATIONS

International Search Report for corresponding patent application No. PCT/CZ2009/000057 dated Jul. 23, 2009.

* cited by examiner

*Primary Examiner* — Catherine A Simone
(74) *Attorney, Agent, or Firm* — Renner, Otto, Boisselle & Sklar, LLP

(57) ABSTRACT

A multi-functional insert, especially a multi-functional insert consisting of a fixation insert (1) made of at least one layer of a flat material that is formed into a spatial shape that contains spatially raised edges (6) and the central part (7), which is compressed, which contains at least one supplementary carrying means (2) and/or supplementary packing means (3).

19 Claims, 6 Drawing Sheets

MULTI-FUNCTIONING INSERT

This application is a national phase of International Application No. PCT/CZ2009/000057 filed 22 Apr. 2009 and published in the English language.

FIELD OF THE INVENTION

The invention deals with a multi-functional insert, especially a multi-functional insert consisting of at least one layer of a flat material that is adapted into a spatial form containing raised edges and the compressed central part.

BACKGROUND

At present, a number of fixation systems are know that enable securing of the position and protection of products in their package during transport.

Such fixation inserts are known that consist of several layers of a flat material that is formed into a spatial shape in such a way that the fixation insert contains spatially raised edges and the central part, which is compressed, while individual layers of the central part are mutually connected by pressure or another connection means. Individual layers are e.g. sewn together with a thread or another linear material.

In the simplest version such a fixation insert contains a central part that is compressed after passing between a pair of rollers. Thus, the central part is only connected by pressure and through the shape memory of individual layers of the compressed material.

The patent no. U.S. Pat. No. 36,555,000 describes a fixation insert that is made of a pair of strips of a flat material that is unwound from rolls. Both the strips are pulled into the production equipment and are wound in such a way that raised marginal parts are formed. While further passing through the production equipment the central part of the newly shaped fixation insert passes over a pair of toothed wheels installed with an overlap towards each other that form the central part in such a manner that it is compressed and its individual layers are connected with a pressure shape joint produced by the toothed wheels.

A similar fixation insert is also known from the patent no. EP 0414849. The spatial arrangement of this insert is similar, but the central part, which is formed through a pressure shape joint, is complemented with perforation, which increases the connection strength of individual layers.

The patent no. EP 0831991 also deals with a fixation insert that is structurally very similar to the above mentioned fixation inserts with the difference that the central part is formed by a pair of wheels containing a number of segments that are mutually shifted along the perimeter in such a way that after the passage of the fixation insert the shaped central part contains a number of recesses with material cut-outs, which considerably increases the stability of the whole fixation insert.

The state of the art shows that a lot of fixation inserts are known whose spatial arrangement is nearly identical as described above while the only difference between them consists in the design of the central part and especially the design of the connection of individual layers of the central part.

A disadvantage of the current state of the art is that the only used capability of the known fixation inserts is fixation of packed transported items consisting in filling and cushioning of the inner space of the transport box.

The aim of this invention is to obtain a fixation insert that will fulfil a number of other functions during the transport of various types of transported items.

SUMMARY OF THE INVENTION

The above mentioned disadvantages are removed to a considerable extent and the aims are fulfilled by a multi-functional insert, especially multi-functional insert consisting of at least one layer of a flat material that is arranged into a spatial form containing spatially raised edges and the compressed central part in accordance with the invention the principle of which is that the fixation insert also contains at least one supplementary carrying means and/or supplementary packing means.

In the most common embodiment at least two layers of the central part are mutually connected by pressure and/or another means of connection. The supplementary carrying means is most conveniently the carrier of some information. The supplementary packing means beneficially brings another supplementary packing characteristic.

The supplementary carrying means and/or the supplementary packing means are advantageously attached to the fixation insert with glue and/or a seam produced with the use of a thread or wire and/or a compressed recess.

The fixation insert is made of discs or sheets of a flat material. This base material is pulled to the production equipment and is folded, compressed or squeezed in such a way that raised edges are formed. The supplementary carrying means and/or the supplementary packing means are attached to the fixation insert in the course of its production.

In the most beneficial alternative the supplementary carrying means and/or the supplementary packing means is attached to the central part of the fixation insert. Especially in this case it is advantageous if the supplementary carrying means and/or the supplementary packing means are attached to the fixation insert in the same way as is used for the joining of individual layers of the central part of the fixation insert. This arrangement makes it possible to conveniently produce the multi-functional insert in one pass through the production equipment.

It is convenient if the supplementary carrying means and/or the supplementary packing means contain a component for anti-corrosion and/or antistatic and/or other surface protection of the packed item. This way the functional characteristics of the whole multi-functional insert are significantly enhanced.

Most advantageously, the basic material of the supplementary carrying means and/or the supplementary packing means is paper or plastic or a woven or non-woven textile or nanotextile.

It is further advantageous if the supplementary carrying means is an adhesive tape. In the most advantageous embodiment the supplementary carrying means is an adhesive tape containing an adhesive component that can be wetted with water. It is also advantageous if the supplementary carrying means and/or the supplementary packing means consist of more layers.

In a beneficial embodiment the supplementary packing means consists of a plastic hose. This allows you to increase the efficiency of the basic fixation insert. At the same time you can e.g. create various types of pockets on the fixation insert and position the transported products in them to increase their stability and protection within the standard package and secondly to increase e.g. their protection against air humidity.

In a beneficial embodiment the supplementary carrying means and/or the supplementary packing means is attached to the fixation insert in an interrupted way. It is also very beneficial if the supplementary carrying means and/or the supplementary packing means contain an information message, which can be and advertising or another message of the company.

All the alternatives of the design of the multi-functional insert in accordance with the invention principally enhance the functional usability of the original fixation insert, which has so far been only usable for spatial stabilization and impact protection of the transported items.

The multi-functional insert in accordance with the invention overcomes the technical prejudice that it is not possible to produce a fixation insert of squeezed paper that would have anything attached to its surface.

The multi-functional insert based on the invention makes it possible e.g. in a simple, cheap and mainly automated technical manner to place an advertising message or personalized information for the consumer of the packed item on the insert. Such information may e.g. have the form of a barcode or one of the international standardized handling symbols. This way the functional value of the whole package is considerably increased in an efficient and simple way.

Simple application of an anti-corrosion or antistatic agent in the packing system or the possibility of any other supplementary surface protection of the packed item is also very convenient.

BRIEF DESCRIPTION OF THE DRAWINGS

The invention will be explained in a more detailed way with the use of a drawing where.

DETAILED DESCRIPTION

Sample 1

Figure 1:
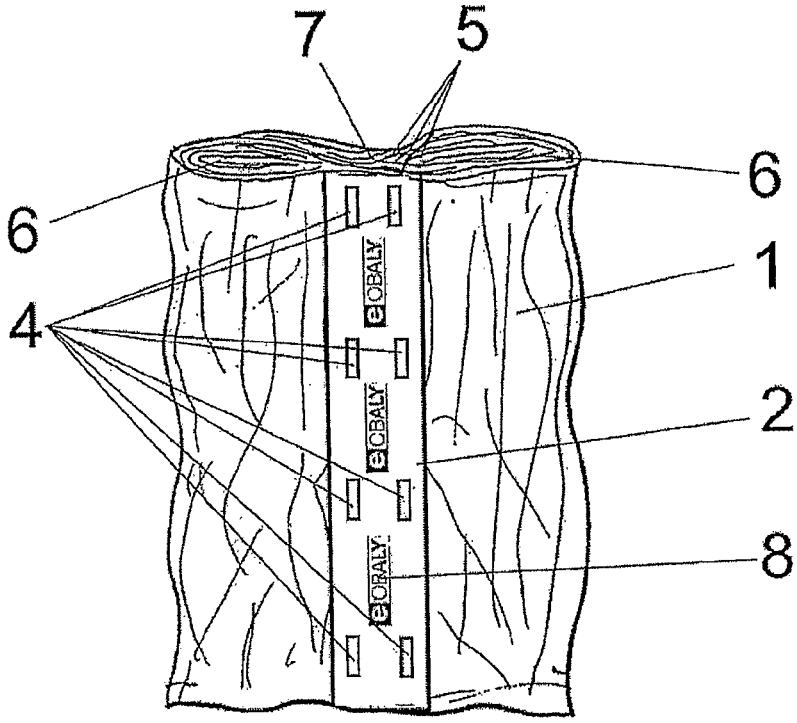
FIG. 1 shows an axonometric view of the multi-functional insert with a supplementary carrying means containing an information message in the form of an advertisement attached by compression.

The multi-functional insert (FIG. 1) consists of the fixation insert 1 made of three layers of a flat material that are formed into a spatial shape that contains spatially raised edges 6 and the central part 7, which is compressed, while individual layers 5 of the central part 7 are mutually connected by pressure and another means of connection represented by a series of compressed recesses 4.

The multi-functional insert contains a supplementary carrying means 2 that contains an information message in the form of an advertisement 8. The supplementary carrying means 2 is attached to the central part 7 of the fixation insert 1 in the same way as individual layers 5 of the central part 7 of the fixation insert 1 are joined together, i.e. by pressure with a compressed recess 4 during the pass through the machine equipment producing the fixation insert 1.

The supplementary carrying means 2 is made of a plastic tape.

The transported item is packed in the multi-functional insert and put in the transport package.

The multi-functional insert fulfils the fixation and shock absorbing function and at the same time provides the end consumer with additional information in the form of an advertisement.

Sample 2

Figure 2:
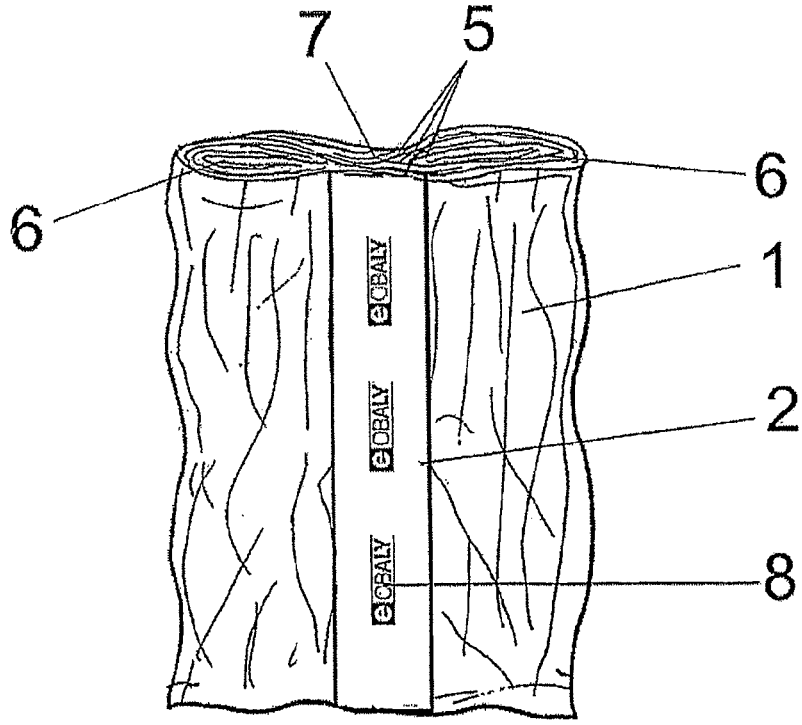
FIG. 2 presents an axonometric view of the multi-functional insert with a supplementary carrying means containing an information message in the form of an advertisement on a paper tape with the adhesive component that can be wetted with water.

The multi-functional insert (FIG. 2) consists of the fixation insert 1 made of three layers of a flat material that are formed into a spatial shape that contains spatially raised edges 6 and the central part 7, which is compressed, while individual layers 5 of the central part 7 are mutually connected by pressure.

The multi-functional insert contains a supplementary carrying means 2 that contains an information message in the form of an advertisement 8.

The supplementary carrying means 2 in the form of a narrow paper tape is attached to the central part 7 of the fixation insert 1 with its adhesive constituent that can be wetted with water and is contained on the surface of the paper tape.

The transported item is packed in the multi-functional insert and put in the transport package.

The multi-functional insert fulfils the fixation and shock absorbing function and at the same time provides the end consumer with additional information in the form of an advertisement.

Sample 3

Figure 3:
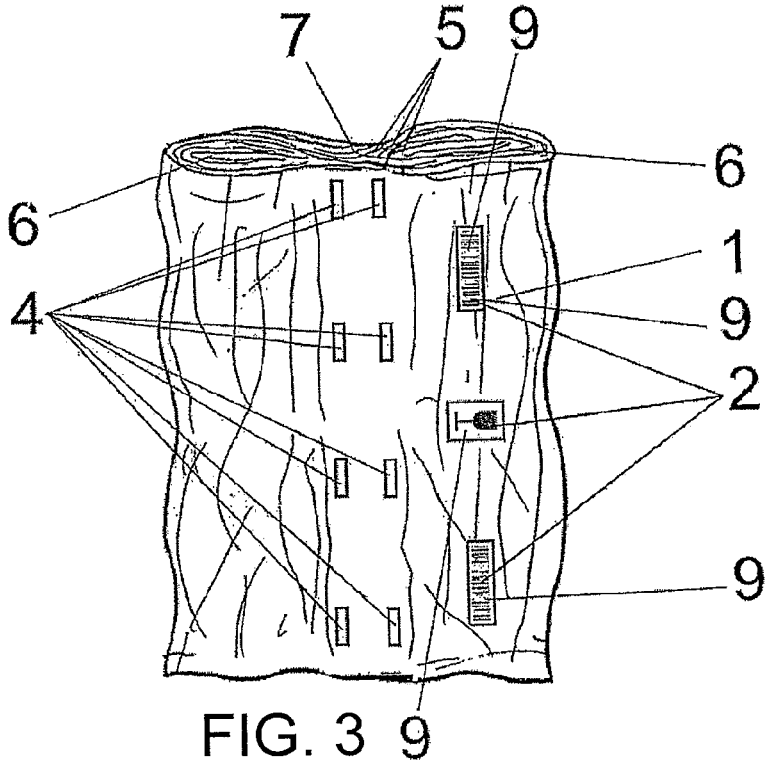
FIG. 3 presents an axonometric view of the multi-functional insert with supplementary carrying means in the form of self-adhesive labels with an information message in the form of a barcode and an internationally standardized handling symbol.

The multi-functional insert (FIG. 3) consists of the fixation insert 1 made of two layers of a flat material that are formed into a spatial shape that contains spatially raised edges 6 and the central part 7, which is compressed, while individual layers 5 of the central part 7 are mutually connected by pressure and another means of connection represented by a series of compressed recesses 4.

The multi-functional insert contains supplementary carrying means 2 in the form of self-adhesive labels 9 that carry an information message on their surface in the form of a barcode and an international standardized handling symbol of fragile items. These labels are attached interruptedly in pre-defined intervals alternately to one of the raised edges 6 of the fixation insert 1.

Before its use the multi-functional insert is divided in such a way that the transported item is packed to a part of the multi-functional insert containing just one label with the barcode and subsequently is put in the transport package.

The multi-functional insert fulfils the fixation and shock absorbing function and at the same time provides the end consumer with additional information about the transported item with the use of a barcode and an international standardized handling symbol.

Sample 4

Figure 4:
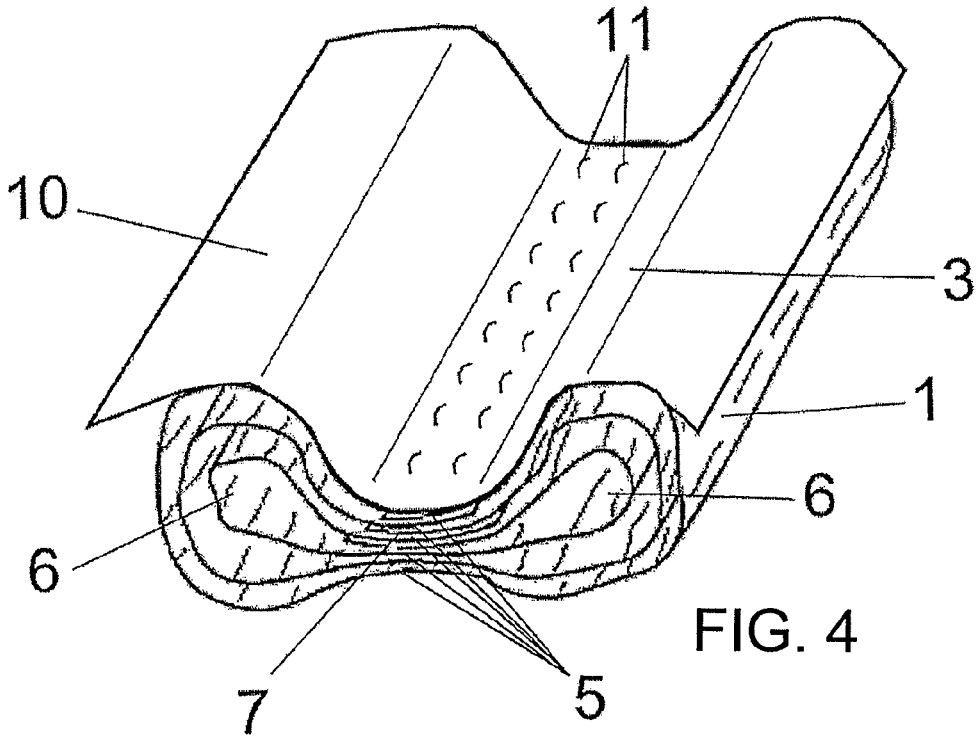
FIG. 4 shows an axonometric view of the multi-functional insert with a supplementary packing means in the form of a strip of a woven textile saturated with an agent for antistatic protection of the packed item.

The multi-functional insert (FIG. 4) consists of the fixation insert 1 made of two layers of a flat material that are formed into a spatial shape that contains spatially raised edges 6 and the central part 7, which is compressed, while individual layers 5 of the central part 7 are mutually connected by pressure.

The multi-functional insert contains a supplementary packing means 3 in the form of a wide strip 10 of a woven textile saturated with an agent for antistatic protection of the packed item. The supplementary packing means 3 is attached to the central part 7 of the fixation insert 1 with a seam 11 made with the use of a thread.

The transported item is encompassed by the multi-functional insert while it is completed packed in the woven textile. Packed this way, the item is put in the transport package.

The multi-functional insert fulfils the fixation and shock absorbing function and the transported item, which may be a sensitive electronic component, is protected from static charge at the same time.

Sample 5

Figure 5:
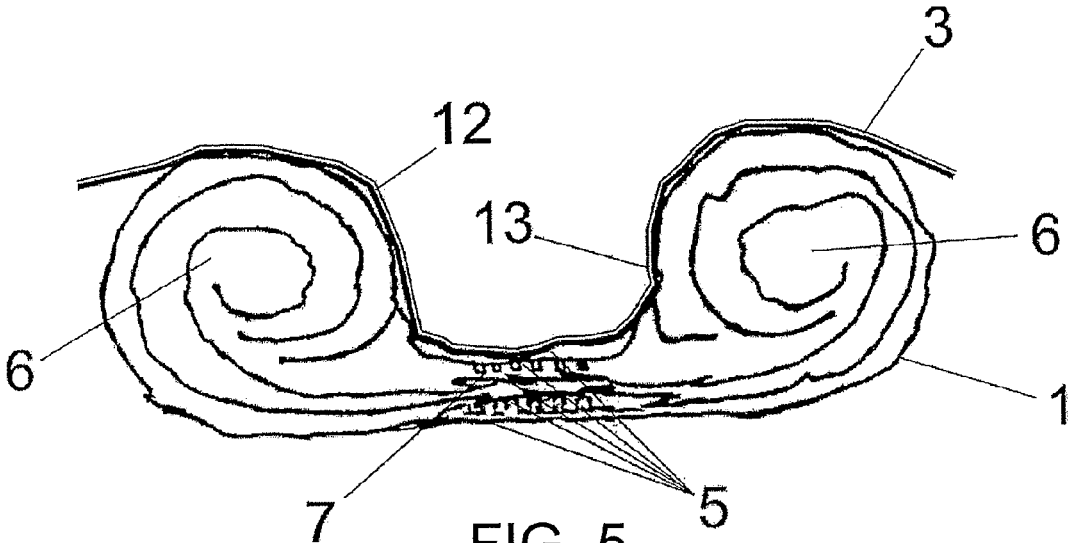
FIG. 5 shows an axonometric view of the multi-functional insert with a supplementary packing means in the form of a paper strip with a plastic layer that contains a constituent for anti-corrosion protection of the packed item.

The multi-functional insert (FIG. 5) consists of the fixation insert 1 made of three layers of a flat material that are formed into a spatial shape that contains spatially raised edges 6 and the central part 7, which is compressed, while individual layers 5 of the central part 7 are mutually connected by pressure and another connection means, which is glue.

The multi-functional insert contains a multi-layer supplementary packing means 3 in the form of a wide paper strip 12 with a plastic layer 13 which contains a constituent for anti-corrosion protection of the packed item.

The supplementary packing means 3 is glued to the central part 7 of the fixation insert 1.

The transported item is encompassed by the multi-functional insert while it is completed packed in the paper strip 12 with the plastic layer 13. Packed this way, the item is put in the transport package.

The multi-functional insert fulfils the fixation and shock absorbing function and the transported item is protected from corrosion at the same time.

Sample 6

Figure 6:
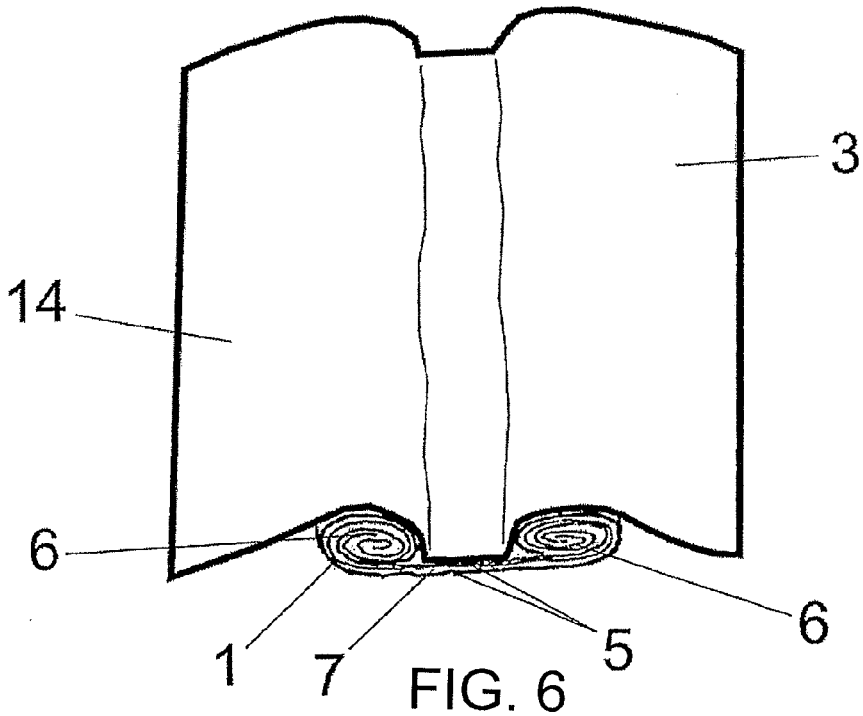
FIG. 6 presents an axonometric view of the multi-functional insert with a supplementary packing means in the form of a nano-textile strip saturated with a constituent for anti-corrosion protection of the packed item.

The multi-functional insert (FIG. 6) consists of the fixation insert 1 made of one layer of a flat material that is formed into a spatial shape that contains spatially raised edges 6 and the central part 7, which is compressed, while individual layers 5 of the central part 7 are mutually connected by pressure.

The multi-functional insert contains a supplementary packing means 3 in the form of a wide nano-textile strip 14 saturated with an agent for anti-corrosion protection of the packed item.

The supplementary packing means 3 is glued to the central part 7 of the fixation insert 1.

The transported item is packed in the multi-functional insert while it is completely encompassed by the nano-textile. Subsequently, it is put in the transport package.

The multi-functional insert fulfils the fixation and shock absorbing function and the transported item is strongly protected from corrosion at the same time.

Sample 7

Figure 7:
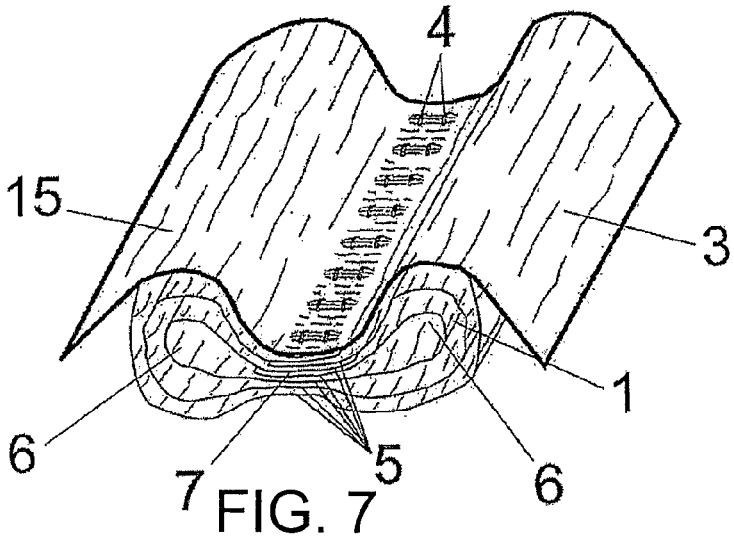
FIG. 7 shows an axonometric view of the multi-functional insert with a supplementary packing means in the form of a textile strip with a special surface for surface protection of especially sensitive packed items.

The multi-functional insert (FIG. 7) consists of the fixation insert 1 made of one layer of a flat material that is formed into a spatial shape that contains spatially raised edges 6 and the central part 7, which is compressed, while individual layers 5 of the central part 7 are mutually connected by pressure and another connection means, which is glue and a series of compressed recesses 4.

The multi-functional insert contains a supplementary packing means 3, which is a wide textile strip 15 with a special surface for surface protection of especially sensitive packed items.

The supplementary packing means 3 is glued to the fixation insert 1 and at the same time fixed with a series of compressed recesses 4, i.e. is attached to the fixation insert 1 in the same way as individual layers 5 of the central part 7 of the fixation insert 1 are joined together.

The transported item is packed in the multi-functional insert while it is encompassed by a textile with a special surface. Subsequently, it is put in the transport package.

The multi-functional insert fulfils the fixation and shock absorbing function and the transported item with sensitive lapped surface is protected from being damaged.

Sample 8

Figure 8:
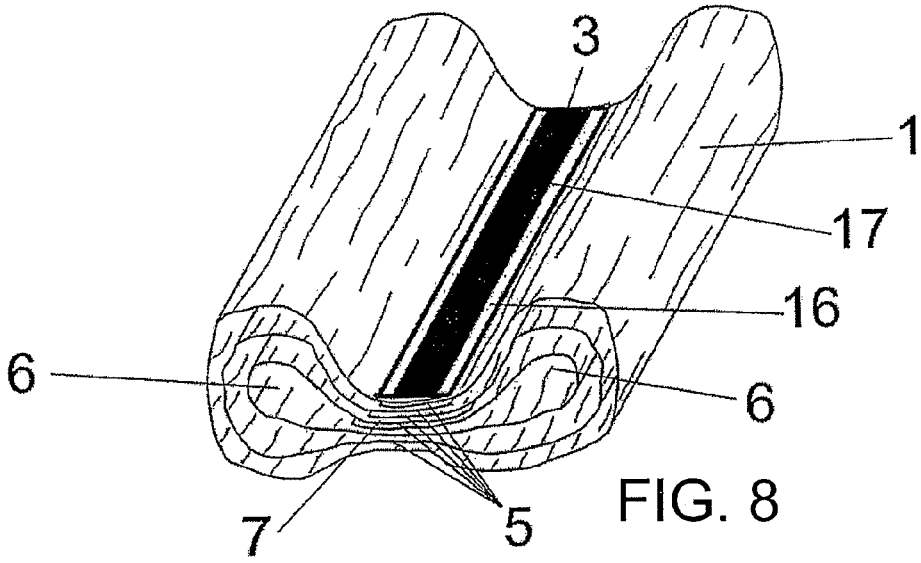
FIG. 8 shows an axonometric view of the multi-functional insert with a supplementary packing means in the form of a plastic tape with a plastic adhesive layer for improved fixation of the packed item.

The multi-functional insert (FIG. 8) consists of the fixation insert 1 made of one layer of a flat material that is formed into a spatial shape that contains spatially raised edges 6 and the central part 7, which is compressed, while individual layers 5 of the central part 7 are mutually connected by pressure.

The multi-functional insert contains a multi-layer supplementary packing means 3 in the form of a plastic tape 16 with a plastic adhesive layer 17 for improved fixation of the packed item.

The supplementary packing means 3 is glued to the central part 7 of the fixation insert 1.

The transported item is packed in the multi-functional insert and at the same time is pushed to the plastic adhesive layer. Subsequently, it is put in the transport package.

The multi-functional insert fulfils the fixation and shock absorbing function and the transported item has a higher degree of protection from movement.

Sample 9

Figure 9:
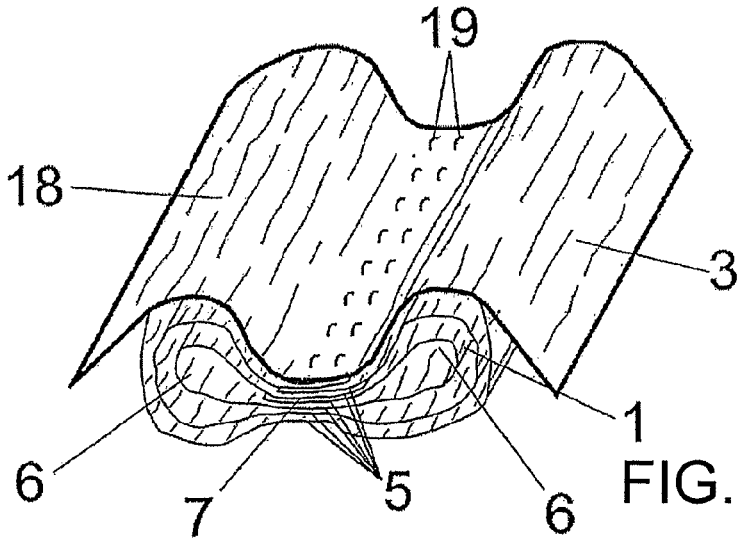
FIG. 9 presents an axonometric view of the multi-functional insert with a supplementary packing means in the form of a paper strip soaked with oil or wax.

The multi-functional insert (FIG. 9) consists of the fixation insert 1 made of two layers of a flat material that is formed into a spatial shape that contains spatially raised edges 6 and the central part 7, which is compressed, while individual layers 5 of the central part 7 are mutually connected by pressure.

The multi-functional insert contains a supplementary packing means 3, which is a wide paper strip 18 soaked with oil or wax.

The supplementary packing means 3 is attached to the central part 7 of the fixation insert 1 with a seam 19 made with the use of a fine wire.

The transported item is packed in the multi-functional insert while it is at the same time completely packed in the paper strip soaked with oil or wax. Subsequently, it is put in the transport package.

The multi-functional insert fulfils the fixation and shock absorbing function while the transported item, which is e.g. a toothed wheel, is protected from corrosion and mechanical damage of its surface.

Sample 10

Figure 10:
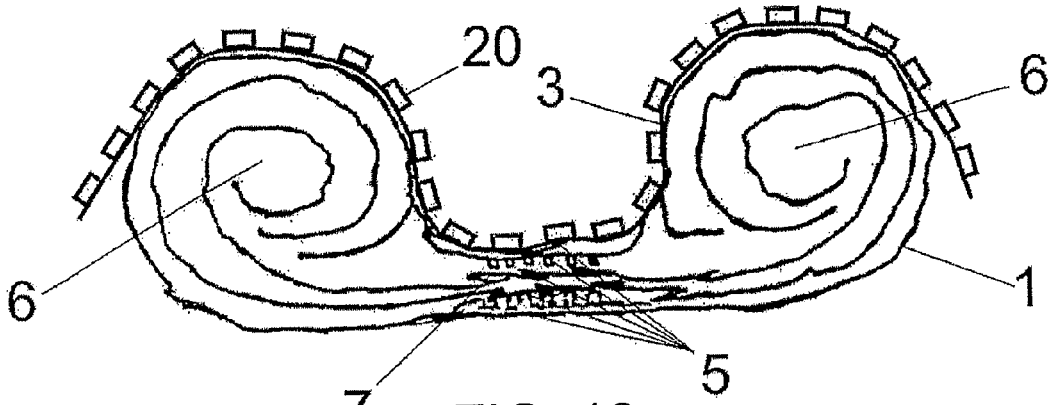
FIG. 10 shows an axonometric view of the multi-functional insert with a supplementary packing means in the form of a bubble foil strip.

The multi-functional insert (FIG. 10) consists of the fixation insert 1 made of two layers of a flat material that are formed into a spatial shape that contains spatially raised edges 6 and the central part 7, which is compressed, while individual layers 5 of the central part 7 are mutually connected by pressure.

The multi-functional insert contains a supplementary packing means 3, which is a bubble foil strip 20.

The supplementary packing means 3 is glued to the central part 7 of the fixation insert 1.

The transported item is packed in the multi-functional insert while it is at the same time completely packed in the bubble foil. Subsequently, it is put in the transport package.

The multi-functional insert fulfils the fixation and shock absorbing function while at the same time the transported item, which is e.g. a fragile work of art, is protected from impacts to an increased extent.

Sample 11

Figure 11:
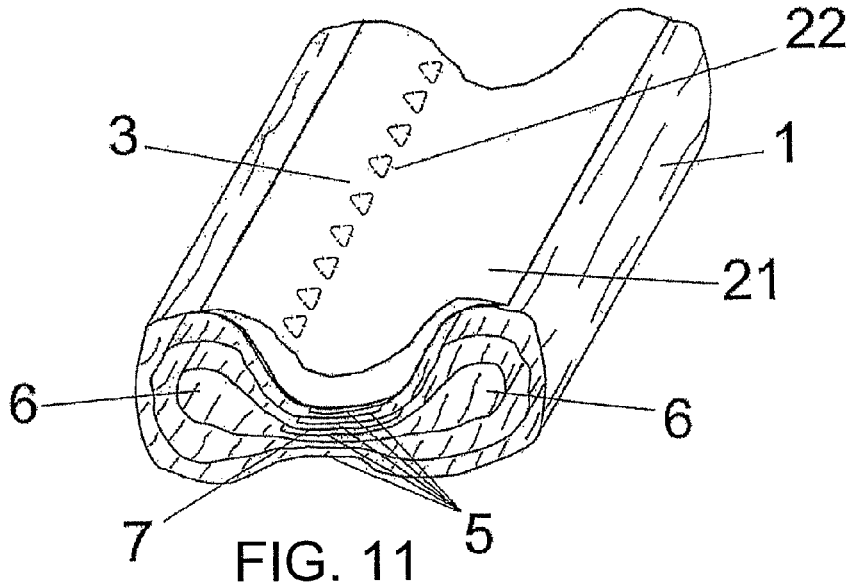
FIG. 11 shows an axonometric view of the multi-functional insert with a supplementary packing means in the form of a plastic hose.

The multi-functional insert (FIG. 11) consists of the fixation insert 1 made of two layers of a flat material that are formed into a spatial shape that contains spatially raised edges 6 and the central part 7, which is compressed, while individual layers 5 of the central part 7 are mutually connected by pressure.

The multi-functional insert contains a supplementary packing means 3, which consists of a plastic hose 21.

The supplementary packing means 3 is glued to the central part 7 of the fixation insert 1 while on its surface it carries an information message 22 in the form of an international standardized handling symbol and a notice of the way of handling of the packed item.

The packed item is encompassed by the multi-functional layer and at the same time it is completely packed in the plastic hose 21. Subsequently, it is put in the transport package.

The multi-functional insert fulfils the fixation and shock absorbing function while the transported item is protected by the plastic hose 21 to an increased extent from environmental impacts and the end consumer of the transported item is informed about the way of handling of the packed item.

Sample 12

Figure 12:
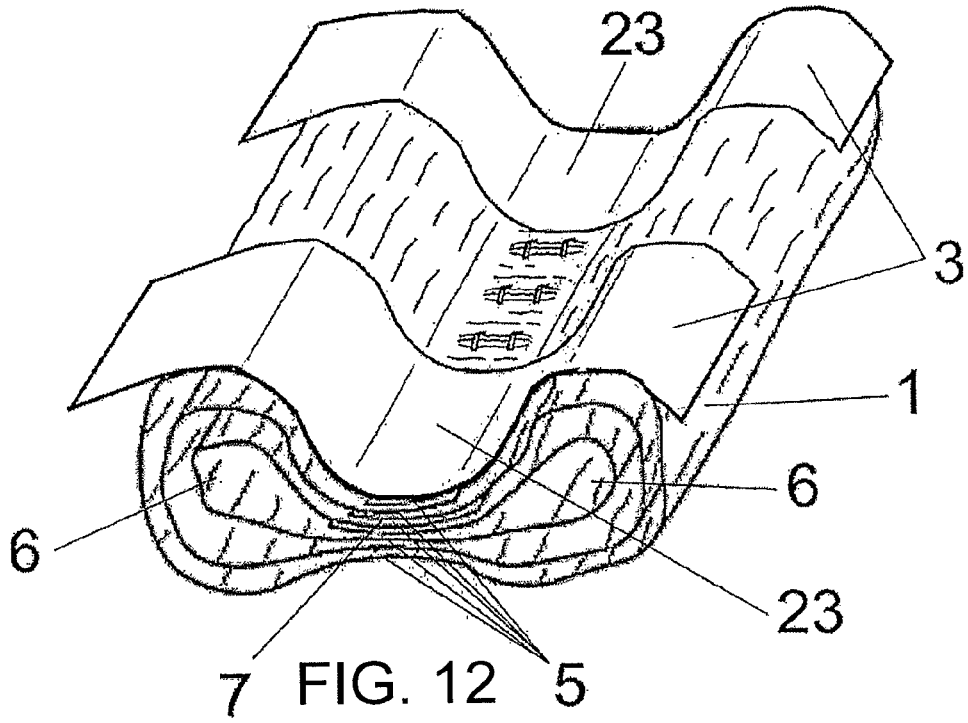
FIG. 12 presents an axonometric view of the multi-functional insert with a pair of supplementary packing means in the form of non-woven textile strips saturated with a constituent for antistatic protection of the packed item and FIG. 13 shows an axonometric view of the multi-functional insert with a pair of supplementary packing means in the form of non-woven textile strips for antistatic protection of the packed item and with a supplementary carrying means in the form of a self-adhesive label with an information message in the form of a barcode.

The multi-functional insert (FIG. 12) consists of the fixation insert 1 made of two layers of a flat material that are formed into a spatial shape that contains spatially raised edges 6 and the central part 7, which is compressed, while individual layers 5 of the central part 7 are mutually connected by pressure.

The multi-functional insert contains a pair of supplementary packing means 3, which is a wide strip 23 of a non-woven textile saturated with an agent for antistatic protection of the packed item. The supplementary packing means 3 is glued to the central part 7 of the fixation insert 1.

The transported item is packed in the multi-functional insert while it is packed in the pair of the non-woven textile strips that overlap each other. Packed this way, it is put in the transport package.

The multi-functional insert fulfils the fixation and shock absorbing function and the transported item, which may be e.g. a computer hard disc, is at the same time protected from static charge.

Figure 13:
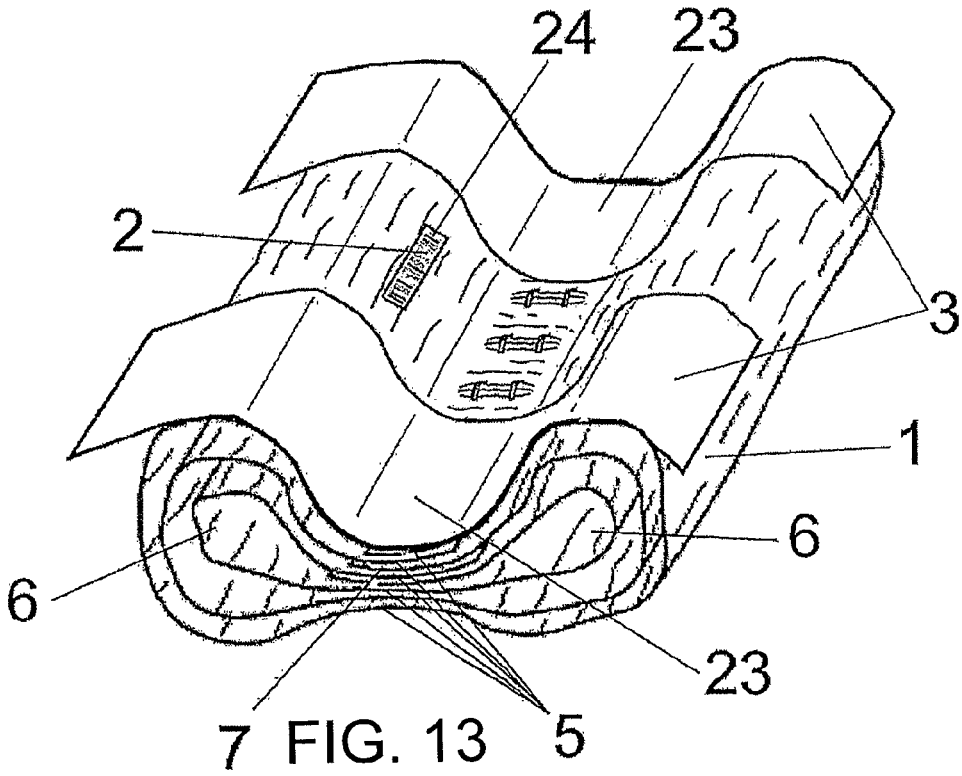

Alternatively (FIG. 13) the above mentioned multi-functional layer contains a supplementary carrying means 2 in the form of a self-adhesive label 24, which on its surface contains an information message in the form of a barcode. This label 24 is attached to one of the raised edges 6 of the fixation insert 1.

Thus, the multi-functional insert additionally provides the end consumer with further information about the transported item with the use of a barcode.

INDUSTRIAL UTILIZATION

The multi-functional insert in accordance with the present invention can be used for multi-functional packing of various items.

LIST OF REFERENCE MARKS

1 Fixation insert
2 Supplementary carrying means
3 Supplementary packing means
4 Compressed recess
5 Layer
6 Edge
7 Central part
8 Advertisement
9 Label
10 Strip I
11 Seam I
12 Paper strip
13 Plastic layer
14 Strip II
15 Strip III
16 Plastic tape
17 Plastic adhesive layer
18 Strip IV
19 Seam II
20 Strip V
21 Plastic hose
22 Information message
23 Strip VI
24 Self-adhesive label

The invention claimed is:

1. A multi-functional insert comprising a fixation insert made of at least one layer of a flat material that is formed into a spatial shape that contains spatially raised edges and a central part, which is compressed, and at least one supplementary carrying means and/or supplementary packing means that overlies the central part of the spatial shape at only one side of the central part and is attached to the fixation insert at the central part, wherein the at least one of the supplementary carrying means and/or the supplementary packing means is attached to the fixation insert in the same way as individual layers of the central part of the fixation insert are joined together.

2. The multi-functional insert in accordance with claim 1, wherein the at least one of the supplementary carrying means and/or the supplementary packing means is attached to the fixation insert with glue and/or a seam made with the use of a thread or a wire and/or a compressed recess.

3. The multi-functional insert in accordance with claim 1, wherein the at least one of the supplementary carrying means and/or the supplementary packing means contains an agent for anti-corrosion protection of a packed item.

4. The multi-functional insert in accordance with claim 1, wherein the at least one of the supplementary carrying means and/or the supplementary packing means is multi-layered.

5. The multi-functional insert in accordance with claim 1 , wherein the supplementary packing means consists of a plastic hose.

6. The multi-functional insert in accordance with claim 1, wherein the at least one of the supplementary carrying means and/or the supplementary packing means formed from paper or plastic or a woven or non-woven textile or a nano-textile.

7. The multi-functional insert in accordance with claim 1, wherein the at least one of the supplementary carrying means and/or the supplementary packing means is attached by embossments to the central part of the fixation insert.

8. The multi-functional insert in accordance with claim 1, wherein the at least one of the supplementary carrying means and/or the supplementary packing means is attached to the fixation insert in an interrupted way.

9. The multi-functional insert in accordance with claim 1, wherein the at least one of the supplementary carrying means and/or the supplementary packing means contains an information message.

10. The multi-functional insert in accordance with claim 1, wherein the spatially raised edges of the spatial shape define therebetween a width of the central part, and the at least one supplementary carrying means and/or the supplementary packing means has a width corresponding to the width of the central part.

11. The multi-functional insert in accordance with claim 1, wherein the at least one supplementary carrying means and/or the supplementary packing means overlies the entire width of the spatial shape.

12. The multi-functional insert in accordance with claim 11, wherein the at least one supplementary carrying means and/or the supplementary packing means imparts to the multi-functional insert a packing characteristic different from that of the fixation insert.

13. The multi-functional insert in accordance with claim 1, wherein the at least one supplementary carrying means and/or the supplementary packing means is a strip carrying information.

14. The multi-functional insert in accordance with claim 13, wherein the strip is attached to the fixation insert in an interrupted way.

15. A multi-functional insert comprising a fixation insert made of at least one layer of a flat material that is formed into a spatial shape that contains spatially raised edges and a central part, which is compressed, and at least one supplementary carrying means and/or supplementary packing means that overlies the central part of the spatial shape at only one side of the central part and is attached to the fixation insert at the central part, wherein the at least one of the supplementary carrying means and/or the supplementary packing means is an adhesive tape containing the adhesive constituent that can be wetted with water.

16. A multi-functional insert comprising a fixation insert made of at least one layer of a flat material that is formed into a spatial shape that contains spatially raised edges and a central part, which is compressed, and a strip carrying information, which strip overlies the central part of the spatial shape at only one side of the central part and is attached to the fixation insert at the central part, wherein the strip is attached by embossments to the central part of the fixation insert.

17. A multi-functional insert comprising a fixation insert made of at least one layer of a flat material that is formed into a spatial shape that contains spatially raised edges and a central part, which is compressed, and a strip carrying information, which strip overlies the central part of the spatial shape at only one side of the central part and is attached to the fixation insert at the central part, wherein the spatially raised edges of the spatial shape define therebetween a width of the central part, and the strip is a paper or plastic strip having a width corresponding to the width of the central part.

18. The multi-functional insert in accordance with claim 17, wherein the at least one of the supplementary carrying means and/or the supplementary packing means is an adhesive tape.

19. The multi-functional insert in accordance with claim 17, wherein the strip is attached by embossments to the central part of the fixation insert.

* * * * *